US011173352B2

(12) United States Patent
Komatsu

(10) Patent No.: US 11,173,352 B2
(45) Date of Patent: Nov. 16, 2021

(54) GOLF BALL WITH BUILT-IN MODULE INCLUDING ELECTRONIC CIRCUIT AND POWER SOURCE

(71) Applicant: Bridgestone Sports Co., Ltd., Tokyo (JP)

(72) Inventor: Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/814,302

(22) Filed: Mar. 10, 2020

(65) Prior Publication Data

US 2020/0384318 A1 Dec. 10, 2020

(30) Foreign Application Priority Data

Jun. 4, 2019 (JP) ..... JP2019-104510

(51) Int. Cl.
*A63B 37/06* (2006.01)
*A63B 43/00* (2006.01)
*A63B 37/00* (2006.01)

(52) U.S. Cl.
CPC ..... *A63B 43/00* (2013.01); *A63B 37/0043* (2013.01); *A63B 37/0056* (2013.01); *A63B 37/0064* (2013.01); *A63B 37/0067* (2013.01); *A63B 2220/44* (2013.01); *A63B 2225/54* (2013.01)

(58) Field of Classification Search
CPC ..... A63B 37/0051; A63B 37/0055
USPC ..... 473/353
See application file for complete search history.

(56) References Cited

U.S. PATENT DOCUMENTS

2015/0379388 A1* 12/2015 Komatsu ..... A63B 37/0064 473/353
2017/0368424 A1* 12/2017 Komatsu ..... A63B 43/004
2018/0369647 A1* 12/2018 Jolliffe ..... A63B 37/0003
2019/0099643 A1 4/2019 Tsutsumi et al.
2019/0290970 A1* 9/2019 Komatsu ..... A63B 37/0043

FOREIGN PATENT DOCUMENTS

JP 2017-225718 A 12/2017
JP 2018-086288 A 6/2018

* cited by examiner

*Primary Examiner* — Raeann Gorden
(74) *Attorney, Agent, or Firm* — Sughrue Mion, PLLC

(57) ABSTRACT

A golf ball according to the present invention includes: a module including an electronic circuit and its power source; a protective layer that surrounds an outer periphery of the module and is formed from a material having a Shore D hardness of at least 60; a core that surrounds an outer periphery of the protective layer; and a cover that surrounds an outer periphery of the core. A weight may be arranged on a surface of the protective layer. A difference between a value MOImax of the moment of inertia in a direction in which the moment of inertia of the golf ball is maximum and a value MOImin of the moment of inertia in a direction in which the moment of inertia of the golf ball is minimum is at most 1.0 g·cm$^2$.

8 Claims, 2 Drawing Sheets

GOLF BALL WITH BUILT-IN MODULE INCLUDING ELECTRONIC CIRCUIT AND POWER SOURCE

CROSS-REFERENCE TO RELATED APPLICATION

This Application claims priority from Japanese Patent Application No. 2019-104510 filed Jun. 4, 2019, which is incorporated herein by reference in its entirety.

BACKGROUND OF THE INVENTION

The present invention relates to a golf ball with a built-in module including an electronic circuit and a power source.

Attempts for embedding an IC chip in a golf ball have been made in order to record information concerning the ball, such as the material, the location of manufacture, and the date of manufacture of the golf ball, in each of the golf balls. For example, JP 2017-225718 A discloses a golf ball including an IC chip embedded therein; and the golf ball includes the IC chip, a protective layer that surrounds the outer periphery of the IC chip, a buffering layer that surrounds the outer periphery of the protective layer, a core that surrounds the outer periphery of the buffering layer and is formed from a rubber composition, and a cover that surrounds the outer periphery of the core, wherein the protective layer is formed from a material having a curing temperature of 60° C. or lower and also having a Shore D hardness of 60 or higher, and the buffering layer is formed from a thermoplastic elastomer-based material having such a hardness that the difference between the hardness of the buffering layer and that of the core surface on the side in contact with the buffering layer is 20 or less in terms of Shore D hardness.

Furthermore, in recent years, such a technology has been developed so as to incorporate not only an IC chip for recording such information therein, but also a sensor for sensing a movement of the ball, into the ball. For example, JP 2018-086288 A discloses a ball that is directed at a baseball ball instead of a golf ball; contains a first sensor for detecting movement of the ball itself, and a hardware including a first communication unit and a battery, in the inside; can communicate with a terminal including a second communication unit which is paired with the first communication unit; and has such a function that when a predetermined action has been applied to the ball and a predetermined movement of the ball itself is detected by the first sensor after the ball has left the hand, the first communication unit and the second communication unit are paired.

SUMMARY OF THE INVENTION

JP 2018-086288 A describes that even when compared with a ball which does not contain the hardware, the ball containing the hardware has a weight and a balance that are almost not different, by having a simplified hardware. However, the hardware is equipped with a power source, and there are limits in simplifying the power source in particular. Also, depending on the type (in particular, size and weight) of the ball with the hardware embedded therein, it is very difficult to equalize the balance. For example, when a baseball ball and a golf ball are compared, the golf ball is smaller and lighter, and accordingly, there is a very high probability that the balance will be lost even though the simplified hardware is embedded. The lack of balance results in greatly affecting the flying distance of the golf ball and a way of rolling by a putter, and there is a problem that the golf ball does not behave as the golf player desires.

In addition, because of the present structure of the golf ball, an impact given to the golf ball upon being hit by a golf club tends to easily reach the inside of the golf ball, and therefore, there is also a problem that there is a high probability that the embedded hardware will be broken and communication will become impossible. In order to protect the hardware from the impact, such a countermeasure can also be taken to wrap the hardware with a protective layer, but there is a problem in that a hit feeling at the time of hitting a golf ball with a golf club becomes worse although this depends on the material of the protective layer.

Then, with respect to the above-described problems, the present invention is directed to providing a golf ball with a built-in module including an electronic circuit and a power source, can prevent damage of the module due to the hitting of the golf ball even though the module provided with the electronic circuit and the power source is embedded in the golf ball, and can reduce an adverse effect on the flying distance of the golf ball and a manner of rolling by the putter, without losing the weight balance of itself.

In order to achieve the above-described object, the present invention provides a golf ball with a built-in module, including: a module including an electronic circuit and a power source; a protective layer that surrounds an outer periphery of the module and is formed from a material having a Shore D hardness of at least 60; a core that surrounds an outer periphery of the protective layer; and a cover that surrounds an outer periphery of the core, wherein a difference between a value MOImax of a moment of inertia in a direction in which the moment of inertia of the golf ball is maximum and a value MOImin of the moment of inertia in a direction in which the moment of inertia of the golf ball is minimum is at most 1.0 $g \cdot cm^2$.

The electronic circuit may have an RFID tag and a sensor incorporated therein. The protective layer or the core preferably includes a weight or a cavity. The weight preferably has a weight of at least 0.1 g. The cavity preferably has a volume of at least 0.1 $cm^3$.

A plurality of the weights or the cavities may be arranged in symmetrical positions with respect to the module. In addition, the shape of the module is a tabular shape, and the plurality of weights may be arranged in positions which are perpendicular to the same plane as the tabular module and are symmetrical with respect to the tabular module. Alternatively, the shape of the module is a tabular shape, and the plurality of cavities may be arranged in positions which are in a direction of the same plane as the tabular module, and are symmetrical with respect to the tabular module.

A material of the core may have a Shore D hardness of 20 to 60. The hardness of the material of the protective layer may be higher than a hardness of a material of the core, and the difference may be 20 to 50 in terms of Shore D hardness.

Thus, according to the present invention, the protective layer that surrounds the outer periphery of the module is formed from the material having the hardness of 60 or higher in terms of Shore D hardness, thereby the protective layer can be prevented from being deformed when the golf ball is hit, and the module can be prevented from being damaged. In addition, the difference between the value MOImax of the moment of inertia in the direction in which the moment of inertia is maximum for the golf ball, the weight balance of which has been lost by the module with a heavy power source being embedded therein, and the value MOImin of the moment of inertia in the direction in which the moment of inertia is minimum for the golf ball has been set to at most 1.0 g·cm$^2$, and accordingly, an adverse effect on the flying distance of the golf ball and the manner of rolling thereof by the putter can be reduced.

DESCRIPTION OF PREFERRED EMBODIMENTS

Hereinafter, one embodiment of a golf ball with a built-in module according to the present invention will be described with reference to the attached drawings. Note that this embodiment is described for facilitating understanding of the present invention, and that the present invention is not limited to this embodiment. In addition, the drawings are not drawn to scale, in order to facilitate understanding of the present invention.

Figure 1:
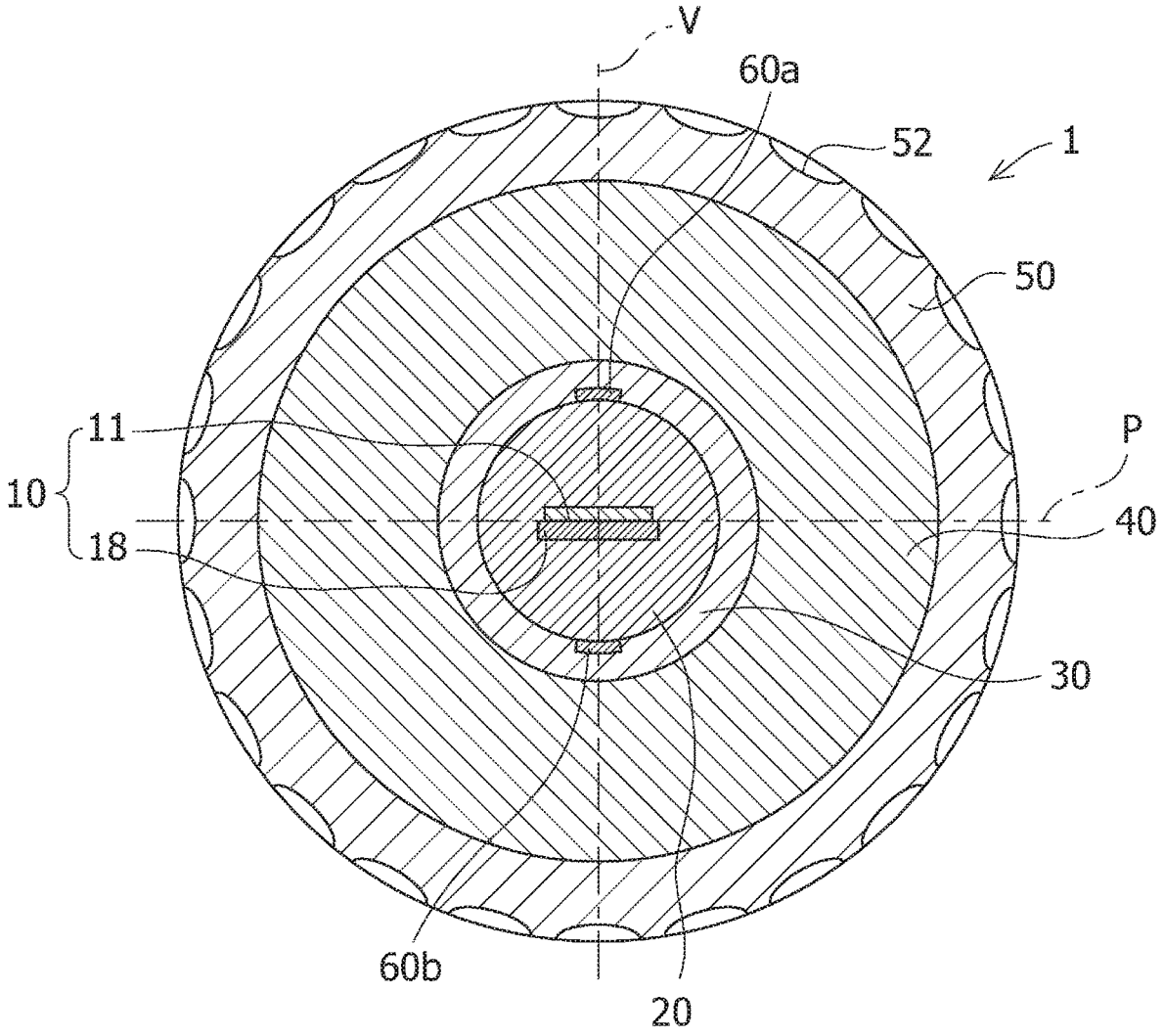
FIG. 1 is a cross-sectional view schematically showing one embodiment of a golf ball according to the present invention.

As is shown in FIG. 1, a golf ball 1 of the present embodiment mainly includes: a module 10 that transmits and receives information through wireless communication; a protective layer 20 that is positioned at the center of the ball and surrounds the module; a buffering layer 30 that surrounds the outside of the protective layer; a core 40 that surrounds the outside of the buffering layer; and a cover 50 that surrounds the outside of the core. A plurality of dimples 52 are formed on the surface of the cover 50.

Figure 2:
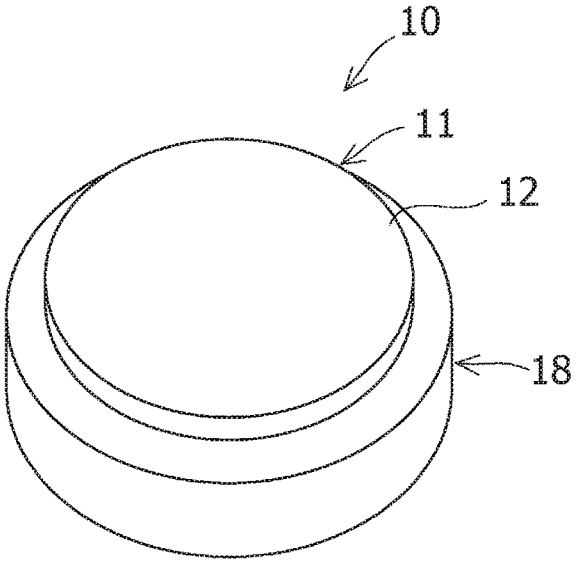
FIG. 2 is a perspective view schematically showing a module to be built-in in the golf ball shown in FIG. 1.

As is shown in FIG. 2, the module 10 includes a substrate 11 having an electronic circuit 12, and a battery 18 that is a power source for the electronic circuit. The details of the electronic circuit 12 are not shown. As the electronic circuit 12, for example, an electronic circuit can be used in which a sensor (not shown) and an RFID (radio frequency identification) tag (not shown) are incorporated, but the electronic circuit 12 is not limited thereto. The sensor can sense a movement of the golf ball, and the examples include a 3-axis acceleration sensor, a 3-axis geomagnetic sensor, and a 3-axis angular velocity sensor. The RFID tag mainly includes an IC chip (not shown) for storage of information and calculation, and an antenna (not shown) for exchanging radio frequency signals with another therethrough. The RFID tag is an active tag which can actively communicate with another by being driven by the battery 18. The substrate 11 is not limited to the disk shape which is shown, and may be a tabular shape such as a rectangular shape. In addition, the battery 18 is also not limited to the disk shape which is shown, and may be the tabular shape such as the rectangular shape. In such a module 10, the battery 18 is larger and heavier than the substrate 11, and therefore, when being incorporated in the golf ball 1, the golf ball 1 results in losing the weight balance of itself.

The outer shape of the protective layer 20 is an approximately spherical shape which is concentric with the golf ball. The module 10 is arranged inside the protective layer 20. The protective layer 20 is formed from a material having a Shore D hardness of 60 or more. Because the protective layer 20 is formed from such a material having high hardness, the golf ball 1 can reduce the deformation of the protective layer 20 that surrounds the module 10, at the time of having been hit by a golf club, and can prevent the electronic circuit 12 of the module 10 from being damaged. The electronic circuit 12 is easily broken, particularly when a sensor is incorporated therein which can sense the movement of the golf ball. The material hardness of the protective layer 20 is more preferably 70 or more, and further preferably 80 or more in terms of Shore D hardness. The upper limit of the material hardness of the protective layer 20 is, but is not limited to, preferably 100 or less.

In addition, the active module 10 has low heat resistance, and accordingly if the curing temperature of the material forming the protective layer 20 is too high, when the protective layer 20 surrounding the module 10 is molded, the module 10, in particular, the built-in battery (not shown) may be damaged. Therefore, it is necessary to control the curing temperature of the material of the protective layer 20 to 60° C. or lower. It is preferable for this curing temperature to be controlled to 50° C. or lower, and is more preferable to be controlled to 40° C. or lower. The lower limit of the curing temperature is not limited particularly, but the material may be cured at room temperature (25° C.).

For example, a room temperature curing type plastic is preferable as such a material which has a Shore D hardness of 60 or more and a curing temperature of 60° C. or less. An acrylic resin, an epoxy resin, a silicone resin, a urethane resin or the like can be used as the room temperature curing type plastic. Thereby, the protective layer can prevent the substrate 11 and the battery 18 in the module 10 from being exposed to the heat. Epoxy resins such as of a bisphenol A type can be used as the epoxy resin, but it is not limited thereto. Resins such as a two-liquid curing type or a UV curing type can be used as the room temperature curing type resin.

A diameter of the protective layer 20 needs to be greater than the diameter of the antenna 16, in order to protect the module 10, and is preferably greater than the diameter of the antenna 16 by a range of 1 to 3 mm. Thus, the diameter of the protective layer 20 is preferably set at 3 mm or greater, and thereby the protective layer can sufficiently protect an IC chip 14 from damage. In addition, the antenna 16 which has been largely widened can improve the readability of the module 10, and accordingly it is preferable to increase the diameter of the protective layer 20. However, if the diameter of the protective layer 20 is too large, the protective layer 20 may adversely affect resilience and durability of the golf ball, because of being formed from a material having a high hardness. Therefore, the diameter of the protective layer 20 is preferably set at 30 mm or less, thereby a region of the core 40 that is positioned outside the protective layer 20 can also be sufficiently secured, and the resilience and the durability of the golf ball can be maintained. The lower limit of the diameter of the protective layer 20 is preferably 4 mm or larger, more preferably 5 mm or greater. In addition, the upper limit of the diameter of the protective layer 20 is preferably 25 mm or less, more preferably 20 mm or less.

The buffering layer 30 is an optionally provided layer, and for example, when the difference in hardness is great between the protective layer 20 and the core 40, can buffer a stress generated between the protective layer 20 and the core 40. In order to exhibit an effect of buffering such a stress, the buffering layer 30 is formed from a material having such a hardness that the difference between the hardness of the buffering layer and the hardness of the surface on the side in contact with the buffering layer of the core 40 which will be described later is 20 or less in terms of Shore D hardness. Thereby, in the core 40 that has been an object which causes a fracture due to the stress concentration, the hardness difference from the adjacent buffering layer 30 becomes small, which accordingly can prevent the stress concentration from occurring. The difference between the material hardness of the buffering layer 30 and the surface hardness of the core 40 is preferably 15 or less, more preferably 10 or less, further preferably 5 or less.

Specifically, the lower limit of the material hardness of the buffering layer 30 is preferably 20 or more, and more preferably 30 or more in terms of Shore D hardness. In addition, the upper limit is preferably 50 or less, and more preferably 40 or less in terms of Shore D hardness. In particular, it is preferable to form the buffering layer 30 from a material having a hardness which is less than the hardness of the surface on the buffering layer side of the core 40. Thereby, even if the material hardness of the protective layer is increased 60 or more in terms of Shore D hardness, the buffering layer 30 which has been made softer can prevent the hardness of the whole golf ball from becoming too high.

In addition, as a material for forming the buffering layer 30, a thermoplastic elastomer is used in terms of compatibility with the adjacent core 40 which is formed from a rubber composition. Thereby, the buffering layer can avoid the stress concentration originating in the hardness difference, and can prevent the core 40 from being peeled from the adjacent layer in the inside.

Usable thermoplastic elastomers include a polyester-based thermoplastic elastomer, a styrene-based thermoplastic elastomer, and a polyurethane-based thermoplastic elastomer, but the thermoplastic elastomer is not limited thereto. In particular, the polyester-based thermoplastic elastomer is preferable in terms of the compatibility with the core 40. As the polyester-based thermoplastic elastomer, for example, "Hytrel" (trade name) can be used which is produced by Du Pont-Toray Co., Ltd. This "Hytrel" (trade name) has a chemical structure of a block copolymer of a hard segment (polybutylene terephthalate (PBT)) and a soft segment (polyether).

In addition, for a material which forms the buffering layer 30, if the melting point thereof is too high, it may damage the module 10, in particular, the built-in battery (not shown) in the protective layer 20, when forming the buffering layer 30 by an injection molding method, and accordingly, it is preferable for the melting point to be set at 230° C. or lower, and is more preferable to be set at 210° C. or lower. If having a melting point of such a temperature, the material can prevent the RFID tag, in particular, the built-in battery in the protective layer from becoming a high temperature, because the temperature of the material of the buffering layer falls rapidly when the material has been injected into the mold. On the other hand, if the melting point is too low of the material which forms the buffering layer 30, the buffering layer 30 that is positioned inside the core may melt or be damaged when the core 40 is vulcanized and formed, and accordingly, it is preferable for the melting point to be set at 80° C. or higher, and is more preferable to be set at 150° C. or higher.

The buffering layer 30 preferably uniformly surrounds the outer periphery of the protective layer 20; and the lower limit of the thickness of the buffering layer 30 is preferably 0.5 mm or more, more preferably 2 mm or more, further preferably 3 mm or more, and most preferably 4 mm or more. On the other hand, the upper limit of the thickness of the buffering layer 30 is, but is not limited to, preferably 10 mm or less, more preferably 8 mm or less, further preferably 6 mm or less. In addition, the buffering layer 30 has been shown to be a single layer in FIG. 1, but it is not limited thereto. For example, the buffering layer 30 may be formed of a plurality of layers.

The core 40 can be formed from a rubber composition containing rubber as a main component. As this rubber (base rubber) serving as the main component, synthetic rubber and natural rubber can be widely used; and usable rubbers include polybutadiene rubber (BR), styrene butadiene rubber (SBR), natural rubber (NR), polyisoprene rubber (IR), polyurethane rubber (PU), butyl rubber (IIR), vinyl polybutadiene rubber (VBR), ethylene propylene rubber (EPDM), nitrile rubber (NBR) and silicone rubber, but the rubber is not limited thereto. As the polybutadiene rubber (BR), for example, 1,2-polybutadiene, cis-1,4-polybutadiene or the like can be used.

In the core 40, the rubber composition can be optionally blended with, for example, a co-crosslinker, a crosslinking initiator, a filler, an anti-aging agent, an isomerizing agent, a peptizing agent, sulfur and an organic sulfur compound, in addition to the abovementioned base rubber. In addition, in place of the rubber, a resin may be used as the main component, and for example, a thermoplastic elastomer, an ionomer resin or a mixture thereof can also be used.

Examples of preferably usable co-crosslinkers include α,β-unsaturated carboxylic acid or a metal salt thereof, but the co-crosslinker is not limited thereto. Examples of the α,β-unsaturated carboxylic acid or the metal salt thereof include: acrylic acid and methacrylic acid; and zinc salts, magnesium salts and calcium salts thereof. A blending ratio of the co-crosslinker is, but is not limited to, for example, preferably approximately 5 parts by weight or more, more preferably approximately 10 parts by weight or more, with respect to 100 parts by weight of the base rubber. In addition, the blending ratio of the co-crosslinker is preferably approximately 70 parts by weight or less, and more preferably approximately 50 parts by weight or less.

As the crosslinking initiator, an organic peroxide is preferably used, and examples thereof include dicumyl peroxide, t-butyl peroxybenzoate, di-t-butyl peroxide, and 1,1-bis (t-butylperoxy)3,3,5-trimethylcyclohexane, but the crosslinking initiator is not limited thereto. The blending ratio of the crosslinking initiator is, when the base rubber is determined to be 100 parts by weight, but is not limited to, preferably approximately 0.10 parts by weight or more, more preferably approximately 0.15 parts by weight or more, further preferably approximately 0.30 parts by weight or more. In addition, the blending ratio of the crosslinking initiator is preferably approximately 8 parts by weight or less, more preferably approximately 6 parts by weight or less.

Examples of usable fillers include silver, gold, cobalt, chromium, copper, iron, germanium, manganese, molybdenum, nickel, lead, platinum, tin, titanium, tungsten, zinc, zirconium, barium sulfate, zinc oxide and manganese oxide, but the filler is not limited thereto. The filler is preferably in the form of a powder. The blending ratio of the filler is, for example, when the base rubber is determined to be 100 parts by weight, but is not limited to, preferably approximately 1 part by weight or more, more preferably approximately 2 parts by weight or more, further preferably approximately 3 parts by weight or more. In addition, the blending ratio of the filler is preferably approximately 100 parts by weight or less, more preferably approximately 80 parts by weight or less, further preferably approximately 70 parts by weight or less.

Examples of usable anti-aging agents include commercialized products such as NOCRAC NS-6 (produced by Ouchi Shinko ChemiCal Industrial Co., Ltd.), but the anti-aging agent is not limited thereto. The blending ratio of the anti-aging agent is, when the base rubber is 100 parts by weight, but is not limited to, preferably approximately 0.1 parts by weight or more, more preferably approximately 0.15 parts by weight or more. In addition, the blending ratio of the anti-aging agent is preferably approximately 1.0 part by mass or less, more preferably approximately 0.7 parts by mass or less.

The resilience of the core 40 can be improved by the addition of an organic sulfur compound (peptizer). The organic sulfur compound is selected from thiophenols, thiocarboxylic acids, and metal salts thereof. As for the thiophenols and the thiocarboxylic acids, there are thiophenols such as pentachlorothiophenol, 4-t-butyl-o-thiophenol, 4-t-butylthiophenol and 2-benzamidothiophenol, and thiocarboxylic acids such as thiobenzoic acid. In addition, as the metal salts thereof, zinc salts and the like are preferable. A blending ratio of the organic sulfur compound is preferably approximately 0.5 parts by weight or more, more preferably approximately 1 part by weight or more, with respect to 100 parts by weight of the base rubber, but the ratio is not limited thereto. The blending ratio of the organic sulfur compound is preferably approximately 3 parts by weight or less, and more preferably approximately 2 parts by weight or less.

It is preferable that the hardness of the core 40 be soft. The protective layer 20 is formed from a material having a high hardness, and accordingly it can be prevented that the hardness of the whole golf ball becomes too high, by the core 40 being made soft as described above. The upper limit of the hardness of the core 40 is preferably 60 or less, more preferably 50 or less, further preferably 40 or less in terms of Shore D hardness. On the other hand, the lower limit of the hardness of the core 40 is, but is not limited to, preferably 20 or more, more preferably 30 or more in terms of Shore D hardness. With the hardness of the core 40 in such a range, the hit feeling of the golf ball 1 can be improved. In addition, it is preferable that the hardness of the core 40 is softer than the material hardness of the protective layer 20, and it is preferable that the difference between the hardness of the protective layer 20 and the hardness of the core is controlled to 20 to 50, for example. By the difference which has been controlled in this range, the hit feeling of the golf ball can be improved, and the durability of the golf ball can also be improved.

It is preferable that the core 40 uniformly surround the outer periphery of the protective layer 20 or the optional buffering layer 30. The lower limit of the thickness of the core 40 may be 4.5 mm or more in order to impart a predetermined repulsive force to the golf ball, and is more preferably 10 mm or more. On the other hand, the upper limit of the thickness of the core 40 is, but is not limited to, preferably 25 mm or less, more preferably 20 mm or less. In addition, the core 40 has been shown to be a single layer in FIG. 1, but it is not limited thereto. For example, the core 40 may be formed of a plurality of layers. In this case, it is preferable that the hardness of each layer of the core be controlled so as to increase from the inside to the outside of the golf ball.

A material which forms the cover 50 includes an ionomer resin, a polyurethane-based thermoplastic elastomer, a thermosetting polyurethane and a mixture thereof, but the material is not limited thereto. In addition, in the cover 50, the abovementioned main component can be blended with other thermoplastic elastomers, polyisocyanate compounds, fatty acids or derivatives thereof, basic inorganic metal compounds, fillers, and the like.

The material which forms the cover 50 has a Shore D hardness of preferably 50 or more, and more preferably 55 or more, but the hardness is not limited thereto. In addition, the material which forms the cover 50 has a Shore D hardness of preferably 75 or less, more preferably 70 or less, further preferably 65 or less.

The lower limit of the thickness of the cover 50 is, but is not limited to, preferably 0.2 mm or more, more preferably 0.4 mm or more. In addition, the upper limit of the thickness of the cover 50 is preferably 4 mm or less, more preferably 3 mm or less, further preferably 2 mm or less. A plurality of dimples 52 are formed on the surface of the cover 50. The size, shape, number and the like of the dimples 52 can be appropriately designed according to desired aerodynamic characteristics of the golf ball 1.

An intermediate layer (not shown) may be optionally provided between the core 40 and the cover 50. An intermediate layer having a function of the core may be provided, or an intermediate layer having a function of the cover may be provided. In addition, a plurality of intermediate layers may be provided; and, for example, a plurality of intermediate layers having the function of the core or the function of the cover may be provided; or a first intermediate layer having the function of the core and a second intermediate layer having the function of the cover may be provided. By the intermediate layer being provided, performances of the golf ball, such as a spin performance and a flying performance, can be improved.

A material which is preferably used as the main material of the intermediate layer is the following heated mixture, but the material is not limited thereto. By this material being used for the intermediate layer, the spin rate can be decreased at the time of impact, and a large flight distance can be obtained. The mixture includes: a base resin in which (a) a binary random copolymer of olefin-unsaturated carboxylic acid, and/or a metal ion neutralized product of a binary random copolymer of olefin-unsaturated carboxylic acid, and (b) a ternary random copolymer of olefin-unsaturated carboxylic acid-unsaturated carboxylic acid ester, and/or a metal ion neutralized product of a ternary random copolymer of olefin-unsaturated carboxylic acid-unsaturated carboxylic acid ester are blended so that the weight ratio of 100:0 to 0:100 is achieved; (e) a non-ionomeric thermoplastic elastomer which is blended so that the weight ratio of 100:0 to 50:50 is achieved with respect to the base resin; (c) 5 to 150 parts by weight of a fatty acid having a molecular weight of 228 to 1500 and/or a derivative thereof, with respect to 100 parts by weight of a resin component containing the base resin and the component (e); and (d) 0.1 to 17 parts by weight of a basic inorganic metal compound which can neutralize an unneutralized acid group in the base resin and the component (c).

Here, the "main material" means a material which is 50% by weight or more, preferably is 60% by weight or more, and further preferably is 70% by weight or more, with respect to the total weight of the intermediate layer.

The material which forms the intermediate layer has a Shore D hardness of preferably 40 or more, more preferably 45 or more, and further preferably 50 or more. The hardness of the material which forms the intermediate layer is preferably softer than the hardness of the cover 50, and specifically, is preferably 65 or less, and more preferably 60 or less in terms of Shore D hardness.

The thickness of the intermediate layer is, but is not limited to, preferably 0.5 mm or more, more preferably 1 mm or more. In addition, the thickness of the intermediate layer is preferably 10 mm or less, more preferably 5 mm or less, further preferably 3 mm or less.

In the golf ball 1 having the above-described configuration, the battery 18 of the module 10 is larger and heavier than the substrate 11, as discussed above, and therefore, even if the module 10 is arranged in the center position of the golf ball 1, the weight balance of the golf ball 1 may result in it being lost. Then, in the present invention, the difference between the value MOImax of the moment of inertia in a direction in which the moment of inertia in the golf ball 1 is maximum and the value MOImin of the moment of inertia in a direction in which the moment of inertia in the golf ball 1 is minimum is controlled to be at most 1.0 $g \cdot cm^2$. Thus, the reduction of the difference between MOImax and MOImin into a value within 1.0 $g \cdot cm^2$ can correct the weight balance that has been lost by the module 10 being embedded, and can reduce the adverse effect on the flying distance of the golf ball and the way of rolling by a putter. The difference between MOImax and MOImin is preferably at most 0.5 $g \cdot cm^2$.

Here, when the module 10 is disk-shaped, the direction in which the moment of inertia of the golf ball 1 is maximum is a direction of the same plane P as the disk-shaped module 10, and the direction in which the moment of inertia of the golf ball 1 is minimum is a direction of a plane perpendicular to the same plane mentioned above.

As one example of means for adjusting such a moment of inertia, a weight 60 may be arranged inside the golf ball 1 as is shown in FIG. 1. The weight 60 may preferably be of a material having the specific gravity higher than that of any material constituting the golf ball described above, and for example, a metal or a metal compound can be used. Examples of usable metals or metal compounds include silver, gold, cobalt, chromium, copper, iron, germanium, manganese, molybdenum, nickel, lead, platinum, tin, titanium, tungsten, zinc, zirconium, barium sulfate, zinc oxide and manganese oxide, but the metal or metal compound is not limited thereto. The weight of the weight 60 is preferably 0.1 g or more, more preferably 0.2 g or more. On the other hand, in order to prevent the weight of the golf ball 1 from becoming heavy, the upper limit is preferably 1.0 g or less, and more preferably 0.8 g or less. The shape of the weight 60 may be, but is not limited to, a sheet shape, a spherical shape, a rectangular solid shape or the like.

As for an arrangement of the weights 60, a plurality thereof, such as two, can be arranged as is shown in FIG. 1. More specifically, in the case in which the shape of the module 10 is a disk shape, the moment of inertia in the direction of the same plane P as that of the disk-shaped module 10 is the maximum value MOImax, and accordingly a plurality of the weights are arranged in positions that are in the direction of the ball axis line V perpendicular to the same plane P and are symmetrical with respect to the module 10. In addition, the weight 60 is preferably arranged in a region of the protective layer 20 or the core 30, and for example, two sheet-shaped weights 60*a* and 60*b* may be arranged on the outer peripheral surface of the protective layer 20, as are shown in FIG. 1.

Figure 3:
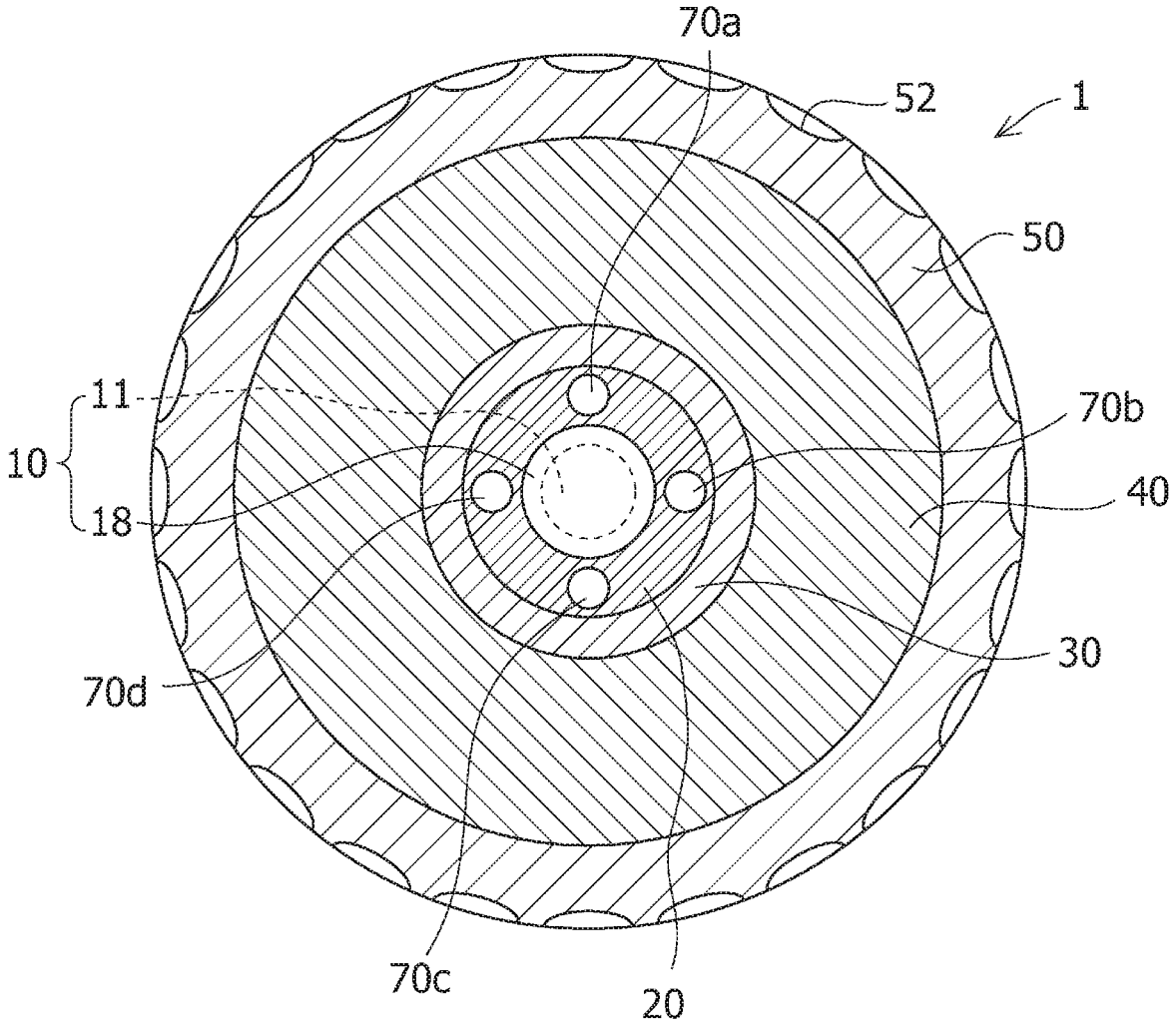
FIG. 3 is a cross-sectional view schematically showing another embodiment of a golf ball according to the present invention and showing a cross section along a bonding surface where a substrate and a battery in a module are bonded.

In addition, as one example of means for adjusting the moment of inertia, a cavity 70 may be arranged inside the golf ball 1 as is shown in FIG. 3. The volume of the cavity 70 is preferably 0.1 $cm^3$ or more, more preferably 0.2 $cm^3$ or more. On the other hand, the upper limit is preferably 1.0 $cm^3$ or less, more preferably 0.8 $cm^3$ or less, in order to reduce the influence on the durability of the golf ball 1 and the like. The shape of the cavity 70 may be, but is not limited to, a spherical shape, a rectangular parallelepiped shape or the like.

As for an arrangement of the cavities 70, a plurality thereof, such as four, can be arranged as is shown in FIG. 3. More specifically, in the case in which the shape of the module 10 is a disk shape, the moment of inertia in the direction of the same plane (paper surface of FIG. 3) as that of the disk-shaped module 10 is the maximum value MOImax, and accordingly a plurality of the cavities are arranged in positions that are in the direction of the same plane P and are symmetrical with respect to the module 10. In addition, the cavity 70 is preferably arranged in a region of the protective layer 20 or the core 30, and for example, four spherical cavities 70*a*, 70*b*, 70*c* and 70*d* may be arranged inside the protective layer 20, as are shown in FIG. 3.

Next, one embodiment of the method for manufacturing the golf ball 1 with the built-in module 10 will be described. The protective layer 20 can be formed, for example, by a compression molding method, an injection molding method or the like, but the method is not limited thereto. Specifically, the module 10 is previously arranged in the mold for the protective layer, which has a predetermined spherical shape, and a material having a predetermined hardness is pressed or injected and introduced into the mold; and thereby the protective layer 20 can be formed in which the module 10 is sufficiently surrounded by the material having a predetermined hardness. The outer peripheral surface of the protective layer 20 may be worked so that irregularities are formed, in order to enhance the adhesiveness with the core 40 or the optional buffering layer 30.

The optional buffering layer 30 can be formed, for example, by an injection molding method or the like, but the method is not limited thereto. Specifically, the protective layer 20 which has been formed as in the above-mentioned way is arranged in the middle of the mold for the buffering layer, and a material for the buffering layer is injected and introduced into the mold so as to cover the protective layer 20; and thereby, the buffering layer 30 can be formed.

The core 40 can be formed, for example, by a half-cup molding method, but the method is not limited thereto. Specifically, a material containing the base rubber is kneaded by a kneader, and then a pair of half cups are molded in advance with the use of the kneaded product; the protective layer 20 or the buffering layer 30 is wrapped by the half cups, and the half cups are heated and vulcanized; and thereby, the half cups are bonded to each other, and the core 40 surrounding the outer periphery of the protective layer 20 or the buffering layer 30 can be formed.

In the case in which the weight 60 is arranged, the weight 60 is arranged together with the module 10 in advance, when the protective layer 20 is formed, and then, the weight 60 can be arranged in the protective layer 20. Alternatively, it is acceptable to form the protective layer 20 embedding the module 10 therein and then attach the weight 60 to the outer peripheral surface of the protective layer 20, or also to incise the outer peripheral surface of the protective layer 20 to create a groove, bury the weight 60 in the groove, and then form the optional buffering layer 30 or the core 40 on the outer periphery. In addition, in the case in which the cavity 70 is arranged, a hollow body that forms the cavity 70 is previously arranged together with the module 10, when the protective layer 20 is formed, and then, the cavity 70 can be arranged in the protective layer 20.

The cover 50 can be formed, for example, by an injection molding method or the like, but the method is not limited thereto. Specifically, the core 40 which has been formed as in the abovementioned way is arranged in the middle of the mold for the cover, and a material for the cover is injected and introduced into the mold so as to cover the core 40; and thereby, the cover 50 can be formed. In this way, the golf ball 1 embedding the module 10 therein can be manufactured.

EXAMPLES

Golf balls were produced which each had a built-in module and the respective structures shown in Table 1, and the golf balls were subjected to tests of measuring rolling by a putter, hit feeling with a driver, and durability of the golf ball. The materials for the protective layer, the core and the cover shown in Table 1 are shown in Table 2. In addition, as the module arranged in the center of the protective layer, a commercially available sensor module was used in common. In addition, this module was disk-shaped; the power source part was 24 mm in diameter, 5 mm in thickness and 6 g in weight; and the substrate part was 24 mm in diameter, 1 mm in thickness and 0.5 g in weight. In addition, lead having a sheet shape was used as a weight. Two weights were arranged at positions that are each on the outer peripheral surface of the protective layer and on the ball axis line perpendicular to the disk-shaped module.

TABLE 1

| | | Example | | | Comparative Example | | |
|---|---|---|---|---|---|---|---|
| | | 1 | 2 | 3 | 1 | 2 | 3 |
| Protective layer | Outer diameter [mm] | 30.0 | 30.0 | 30.0 | 30.0 | 30.0 | 30.0 |
| | Material | A | A | A | A | A | B |
| | Material hardness | 80 | 80 | 80 | 80 | 80 | 55 |
| Core | Outer diameter [mm] | 40.0 | 40.0 | 40.0 | 40.0 | 40.0 | 40.0 |
| | Material | C | C | A | C | C | C |
| | Material hardness | 45 | 45 | 80 | 45 | 45 | 45 |
| Cover | Thickness [mm] | 1.35 | 1.35 | 1.35 | 1.35 | 1.35 | 1.35 |
| | Material | B | B | B | B | B | B |
| | Material hardness | 55 | 55 | 55 | 55 | 55 | 55 |
| Hardness difference (protective layer - core) | | 35 | 35 | 0 | 35 | 35 | 10 |
| Adjustment of moment of inertia | | Weight | Weight | Weight | None | Weight | Weight |
| | Weight and number | 0.4 g × 2 | 0.2 g × 2 | 0.4 g × 2 | — | 0.08 g × 2 | 0.4 g × 2 |
| Moment of inertia [g · cm$^2$] | MOImax | 83.0 | 83.0 | 83.0 | 83.0 | 83.0 | 83.0 |
| | MOImin | 82.8 | 82.1 | 82.8 | 80.6 | 81.8 | 82.8 |
| | Difference | 0.2 | 0.9 | 0.2 | 2.4 | 1.2 | 0.2 |
| Evaluation results | Rolling by putter | Excellent | Good | Excellent | Poor | Poor | Excellent |
| | Hit feeling | Good | Good | Fair | Good | Good | Good |
| | COR durability | Good | Good | Good | Good | Good | Poor |

TABLE 2

| | Material |
|---|---|
| A | Epoxy resin |
| B | Ionomer A |
| C | Ionomer B |

The epoxy resin is a two-liquid room temperature curing type epoxy resin with trade name Crystal Resin made by Nissin Resin Co., Ltd.

Ionomer A is a mixture of the trade names High Milan 1605 and High Milan 1706 produced by Dow-Mitsui Polychemicals Co., Ltd.

Ionomer B is a trade name HPF2000 produced by DuPont.

The material hardness of any of the protective layer, the core, and the cover in Table 1 is in terms of Shore D hardness. The measurement method will be described below. The material to be measured was formed into a sheet shape having a thickness of 2 mm, the sheets were stored at 23° C. for 2 weeks, the resultant sheets were stacked so that the thickness became 6 mm or more, and the stacked sheet was subjected to measurement with the use of a durometer of a Type D, which conformed to the ASTM D2240-95 standard.

The golf balls in Table 1 were subjected the measurement of the moment of inertia with the use of a machine for measuring the moment of inertia (M01-005 manufactured by Inertia Dynamics, Inc.). This measuring machine calculates the moment of inertia of a golf ball from the difference between the period of vibration at the time when the golf ball is placed on a holder of the measuring machine, and the period of vibration at the time when the golf ball is not placed. In addition, the moment of inertia was measured in such a state that the protective layer having the module arranged in the center formed a sphere, before the sphere was molded to form a golf ball. As a result, in this sphere of the protective layer, the moment of inertia in a direction horizontal to the disc-shaped module was 12.83 g·cm$^2$, and the moment of inertia in a direction perpendicular to the module was 10.44 g·cm$^2$.

The "putter rolling" in Table 1 was measured by mounting a putter on a golf striking robot, and the robot hit the golf ball at a head speed of 7 m/s, toward a target 5 m ahead. Then, a distance deviating from the target to the right or left was measured. As for the evaluation, Excellent is 25 cm or shorter, Good is longer than 25 and 50 cm or shorter, and Poor is longer than 50 cm.

The "hit feeling" in Table 1 was evaluated by sensory evaluation obtained when 10 amateur golfers actually hit the ball, who showed a head speed (HS) of 35 to 45 m/s when having used a W #1 club. Then, on the basis of the results of the sensory evaluation, the hit feeling was evaluated according to the following criteria.

Good: 8 to 10 people evaluated that the hit feeling was good.

Fair: 3 to 7 people evaluated that the hit feeling was good.

Poor: 0 to 2 people evaluated that the hit feeling was good.

As for the "COR durability" in Table 1, the durability of the sensor module inside the golf ball was evaluated with the use of an ADC Ball COR Durability Tester manufactured by Automated Design Corporation in U.S.A. This testing machine has a function of discharging a golf ball with air pressure and colliding the golf ball continuously against two metal plates which are installed in parallel. An incident speed on the metal plate was set at 43 m/s. The average number of times of discharge was determined which was repeated by the time when the sensor module in the golf ball became unable to communicate. In this case, the average value is a value which was obtained by operations of preparing five balls of each sample, discharging each of the balls, and averaging the numbers of discharge which was repeated by the time when any of the five balls became unable to communicate. As for evaluation, Good is 60 times or more, and Poor is less than 60 times.

As shown in Table 1, a golf ball of Example 1 included the protective layer formed from a material having a Shore D hardness of 80, and two weights of 0.4 g arranged at positions located on the surface of the protective layer vertically symmetrically with respect to the module in order to adjust the moment of inertia. The golf ball showed excellent durability with the module being protected by the protective layer; was excellent in the hit feeling because of the core having the hardness lower than that of the protective layer by 35; and, rolled and travelled straight when having been hit by a putter, because the difference between the value MOImax of the maximum moment of inertia and the value MOImin of the minimum moment of inertia of the golf ball was as small as 0.2, the results were very satisfactory. In addition, in Example 2 in which the weight was reduced to 0.2 g, the difference between the MOImax and the MOImin became as large as 0.9, but wobbling was small during rolling of the golf ball by the putter, and the evaluation was satisfactory. Furthermore, in Example 2 in which the hardness of the core was controlled to the same hardness as that of the protective layer, the golfers who answered that the hit feeling was good decreased slightly, but evaluation results were generally satisfactory.

In contrast to this, in Comparative Example 1 in which any weight was not arranged at all, the difference between the MOImax and the MOImin was as large as 2.4, and the golf ball greatly deviated to the right or left as a result of rolling by a putter. In Comparative Example 2 in which two of weights with 0.08 g were arranged at positions which were on the surface of the protective layer and vertically symmetrical with respect to the module, the weight was very light, and accordingly the difference between the MOImax and the MOImin was still as large as 1.2; and the golf ball greatly deviated to the right or left as a result of rolling by a putter, similarly to Comparative Example 1. In addition, in Comparative Example 3 in which the protective layer was formed from a material having a Shore D hardness of 55, the module was not sufficiently protected and became enable to communicate.

What is claimed is:

1. A golf ball with a built-in module, comprising:

a module including an electronic circuit and a power source;

a protective layer that surrounds an outer periphery of the module and is formed from a material having a Shore D hardness of at least 60;

a core that surrounds an outer periphery of the protective layer; and a cover that surrounds an outer periphery of the core, wherein a difference between a value MOImax of a moment of inertia in a direction in which the moment of inertia of the golf ball is maximum and a value MOImin of the moment of inertia in a direction in which the moment of inertia of the golf ball is minimum is at most 1.0 g $cm^2$, wherein the protective layer or the core comprises a weight or a cavity, and wherein a plurality of the weights or the cavities are arranged in symmetrical positions with respect to the module.

2. The golf ball according to claim 1, wherein the electronic circuit comprises an RFID tag and a sensor that are incorporated therein.

3. The golf ball according to claim 1, wherein a weight of the weight is at least 0.1 g.

4. The golf ball according to claim 1, wherein a volume of the cavity is at least 0.1 $cm^3$.

5. The golf ball according to claim 1, wherein the module has a tabular shape, and the plurality of weights are arranged in positions which are perpendicular to the same plane as the tabular module and are symmetrical with respect to the tabular module.

6. The golf ball according to claim 1, wherein the module has a tabular shape, and the plurality of cavities are arranged in positions which are in a direction of the same plane as the tabular module, and are symmetrical with respect to the tabular module.

7. The golf ball according to claim 1, wherein a material of the core has a Shore D hardness of a range from 20 to 60.

8. The golf ball according to claim 1, wherein the hardness of the material of the protective layer is higher than a hardness of a material of the core, and a difference therebetween is a range from 20 to 50 in terms of Shore D hardness.

* * * * *